US008317555B2

(12) United States Patent
Jacobsen et al.

(10) Patent No.: US 8,317,555 B2
(45) Date of Patent: Nov. 27, 2012

(54) AMPHIBIOUS ROBOTIC CRAWLER

(75) Inventors: Stephen C. Jacobsen, Salt Lake City, UT (US); Fraser M. Smith, Salt Lake City, UT (US); Marc X. Olivier, Salt Lake City, UT (US)

(73) Assignee: Raytheon Company, Waltham, MA (US)

( * ) Notice: Subject to any disclaimer, the term of this patent is extended or adjusted under 35 U.S.C. 154(b) by 141 days.

(21) Appl. No.: 12/814,302

(22) Filed: Jun. 11, 2010

(65) Prior Publication Data

US 2010/0317244 A1 Dec. 16, 2010

Related U.S. Application Data

(60) Provisional application No. 61/186,289, filed on Jun. 11, 2009.

(51) Int. Cl.
*B63H 19/08* (2006.01)

(52) U.S. Cl. ..... 440/12.63; 114/312

(58) Field of Classification Search ..... 440/12.63; 114/312

See application file for complete search history.

(56) References Cited

U.S. PATENT DOCUMENTS

| | | | | |
|---|---|---|---|---|
| 1,107,874 | A | 8/1914 | Appleby | |
| 1,112,460 | A | 10/1914 | Leavitt | |
| 1,515,756 | A | 11/1924 | Roy | |
| 1,975,726 | A | 10/1934 | Martinage | |
| 2,082,920 | A | 6/1937 | Aulmont | |
| 3,107,643 | A * | 10/1963 | Edwards | 440/100 |
| 3,166,138 | A | 1/1965 | Dunn, Jr. | |
| 3,190,286 | A | 6/1965 | Stokes | |
| 3,215,219 | A | 11/1965 | Forsyth | |
| 3,223,462 | A | 12/1965 | Dalrymple | |
| 3,266,059 | A | 8/1966 | Stelle | |
| 3,284,964 | A | 11/1966 | Saito | |
| 3,311,424 | A | 3/1967 | Taylor | |
| 3,362,492 | A | 1/1968 | Hansen | |
| 3,387,896 | A | 6/1968 | Sobota | |
| 3,489,236 | A | 1/1970 | Goodwin | |
| 3,497,083 | A | 2/1970 | Anderson | |

(Continued)

FOREIGN PATENT DOCUMENTS

CA 2512299 9/2004

(Continued)

OTHER PUBLICATIONS

U.S. Appl. No. 12/694,996; filed Jan. 27, 2010; Stephen C. Jacobsen; Office Action Issued Sep. 30, 2010.

(Continued)

*Primary Examiner* — Stephen Avila
(74) *Attorney, Agent, or Firm* — Thorpe North & Western LLP

(57) ABSTRACT

An amphibious robotic crawler for traversing a body of water having two frame units coupled end-to-end or in tandem by an actuated linkage arm. Each frame unit includes a housing with a drivable continuous track rotatably supported thereon. The frame units are operable with a power supply, a drive mechanism and a control module. Each frame unit further includes a buoyancy control element for suspending the frame unit in the water, and for controlling the depth of the robotic crawler within the water. The control module coordinates the rotation of the continuous tracks, the position of the linkage arm and the buoyancy of the buoyancy control elements to control movement, direction and pose of the robotic crawler through the body of water.

40 Claims, 4 Drawing Sheets

U.S. PATENT DOCUMENTS

| | | | | | |
|---|---|---|---|---|---|
| 3,565,198 | A | | 2/1971 | Ames | |
| 3,572,325 | A | | 3/1971 | Bazell | |
| 3,609,804 | A | | 10/1971 | Morrison | |
| 3,650,343 | A | | 3/1972 | Helsell | |
| 3,700,115 | A | | 10/1972 | Johnson | |
| 3,707,218 | A | | 12/1972 | Payne | |
| 3,712,481 | A | | 1/1973 | Harwood | |
| 3,715,146 | A | | 2/1973 | Robertson | |
| 3,757,635 | A | | 9/1973 | Hickerson | |
| 3,808,078 | A | | 4/1974 | Snellman | |
| 3,820,616 | A | | 6/1974 | Juergens | |
| 3,841,424 | A | | 10/1974 | Purcell | |
| 3,864,983 | A | | 2/1975 | Jacobsen | |
| 3,933,214 | A | | 1/1976 | Guibord | |
| 3,934,664 | A | | 1/1976 | Pohjola | |
| 3,974,907 | A | | 8/1976 | Shaw | |
| 4,015,553 | A | * | 4/1977 | Middleton | 114/245 |
| 4,051,914 | A | | 10/1977 | Pohjola | |
| 4,059,315 | A | | 11/1977 | Jolliffe | |
| 4,068,905 | A | | 1/1978 | Black | |
| 4,107,948 | A | | 8/1978 | Maolaug | |
| 4,109,971 | A | | 8/1978 | Black | |
| 4,132,279 | A | | 1/1979 | Van der Lende | |
| 4,218,101 | A | | 8/1980 | Thompson | |
| 4,260,053 | A | | 4/1981 | Onodera | |
| 4,332,317 | A | | 6/1982 | Bahre | |
| 4,332,424 | A | | 6/1982 | Thompson | |
| 4,339,031 | A | | 7/1982 | Densmore | |
| 4,393,728 | A | | 7/1983 | Larson | |
| 4,396,233 | A | | 8/1983 | Slaght | |
| 4,453,611 | A | | 6/1984 | Stacy, Jr. | |
| 4,483,407 | A | | 11/1984 | Iwamoto et al. | |
| 4,489,826 | A | | 12/1984 | Dubson | |
| 4,494,417 | A | | 1/1985 | Larson | |
| 4,551,061 | A | | 11/1985 | Olenick | |
| 4,589,460 | A | | 5/1986 | Albee | |
| 4,621,965 | A | | 11/1986 | Wilcock | |
| 4,636,137 | A | | 1/1987 | Lemelson | |
| 4,646,906 | A | | 3/1987 | Wilcox, Jr. | |
| 4,661,039 | A | | 4/1987 | Brenholt | |
| 4,671,774 | A | * | 6/1987 | Owsen | 440/95 |
| 4,700,693 | A | | 10/1987 | Lia | |
| 4,706,506 | A | | 11/1987 | Lestelle | |
| 4,712,969 | A | | 12/1987 | Kimura | |
| 4,713,896 | A | * | 12/1987 | Jennens | 37/308 |
| 4,714,125 | A | | 12/1987 | Stacy, Jr. | |
| 4,727,949 | A | | 3/1988 | Rea | |
| 4,736,826 | A | | 4/1988 | White et al. | |
| 4,752,105 | A | | 6/1988 | Barnard | |
| 4,756,662 | A | | 7/1988 | Tanie | |
| 4,765,795 | A | | 8/1988 | Rebman | |
| 4,784,042 | A | | 11/1988 | Paynter | |
| 4,796,607 | A | | 1/1989 | Allred, III | |
| 4,806,066 | A | | 2/1989 | Rhodes | |
| 4,815,319 | A | | 3/1989 | Clement | |
| 4,815,911 | A | | 3/1989 | Bengtsson | |
| 4,818,175 | A | | 4/1989 | Kimura | |
| 4,828,339 | A | | 5/1989 | Thomas | |
| 4,828,453 | A | | 5/1989 | Martin et al. | |
| 4,848,179 | A | | 7/1989 | Ubhayakar | |
| 4,862,808 | A | | 9/1989 | Hedgecoxe | |
| 4,878,451 | A | | 11/1989 | Siren | |
| 4,900,218 | A | | 2/1990 | Sutherland | |
| 4,909,341 | A | | 3/1990 | Rippingale | |
| 4,924,153 | A | | 5/1990 | Toru et al. | |
| 4,932,491 | A | | 6/1990 | Collins, Jr. | |
| 4,932,831 | A | | 6/1990 | White et al. | |
| 4,936,639 | A | | 6/1990 | Pohjola | |
| 4,997,790 | A | | 3/1991 | Woo | |
| 5,018,591 | A | | 5/1991 | Price | |
| 5,021,798 | A | | 6/1991 | Ubhayakar | |
| 5,022,812 | A | | 6/1991 | Coughlan | |
| 5,046,914 | A | | 9/1991 | Holland et al. | |
| 5,080,000 | A | | 1/1992 | Bubic | |
| 5,130,631 | A | | 7/1992 | Gordon | |
| 5,142,932 | A | | 9/1992 | Moya | |
| 5,174,168 | A | | 12/1992 | Takagi | |
| 5,174,405 | A | | 12/1992 | Carra | |
| 5,186,526 | A | | 2/1993 | Pennington | |
| 5,199,771 | A | | 4/1993 | James | |
| 5,205,612 | A | | 4/1993 | Sugden et al. | |
| 5,214,858 | A | | 6/1993 | Pepper | |
| 5,219,264 | A | | 6/1993 | McClure et al. | |
| 5,252,870 | A | | 10/1993 | Jacobsen | |
| 5,297,443 | A | | 3/1994 | Wentz | |
| 5,317,952 | A | | 6/1994 | Immega | |
| 5,337,732 | A | | 8/1994 | Grundfest | |
| 5,350,033 | A | | 9/1994 | Kraft | |
| 5,354,124 | A | | 10/1994 | James | |
| 5,363,935 | A | | 11/1994 | Schempf | |
| 5,386,741 | A | | 2/1995 | Rennex | |
| 5,413,454 | A | | 5/1995 | Movsesian | |
| 5,426,336 | A | | 6/1995 | Jacobsen | |
| 5,428,713 | A | | 6/1995 | Matsumaru | |
| 5,435,405 | A | | 7/1995 | Schempf | |
| 5,440,916 | A | | 8/1995 | Stone et al. | |
| 5,443,354 | A | | 8/1995 | Stone et al. | |
| 5,451,135 | A | | 9/1995 | Schempf | |
| 5,465,525 | A | | 11/1995 | Mifune | |
| 5,466,056 | A | | 11/1995 | James | |
| 5,469,756 | A | | 11/1995 | Feiten | |
| 5,516,249 | A | | 5/1996 | Brimhall | |
| 5,551,545 | A | | 9/1996 | Gelfman | |
| 5,556,370 | A | | 9/1996 | Maynard | |
| 5,562,843 | A | | 10/1996 | Yasumoto | |
| 5,567,110 | A | | 10/1996 | Sutherland | |
| 5,570,992 | A | | 11/1996 | Lemelson | |
| 5,573,316 | A | | 11/1996 | Wankowski | |
| 5,588,688 | A | | 12/1996 | Jacobsen | |
| 5,672,044 | A | | 9/1997 | Lemelson | |
| 5,697,285 | A | | 12/1997 | Nappi | |
| 5,712,961 | A | | 1/1998 | Matsuo | |
| 5,749,828 | A | | 5/1998 | Solomon | |
| 5,770,913 | A | | 6/1998 | Mizzi | |
| 5,816,769 | A | | 10/1998 | Bauer | |
| 5,821,666 | A | | 10/1998 | Matsumoto | |
| 5,842,381 | A | | 12/1998 | Feiten | |
| RE36,025 | E | | 1/1999 | Suzuki | |
| 5,878,783 | A | | 3/1999 | Smart | |
| 5,888,235 | A | | 3/1999 | Jacobsen | |
| 5,902,254 | A | | 5/1999 | Magram | |
| 5,906,591 | A | | 5/1999 | Dario | |
| 5,984,032 | A | | 11/1999 | Gremillion | |
| 5,996,346 | A | | 12/1999 | Maynard | |
| 6,016,385 | A | | 1/2000 | Yee | |
| 6,030,057 | A | | 2/2000 | Fikse | |
| 6,056,237 | A | | 5/2000 | Woodland | |
| 6,107,795 | A | | 8/2000 | Smart | |
| 6,109,705 | A | | 8/2000 | Courtemanche | |
| 6,113,343 | A | | 9/2000 | Goldenberg et al. | |
| 6,132,133 | A | | 10/2000 | Muro et al. | |
| 6,138,604 | A | | 10/2000 | Anderson | |
| 6,162,171 | A | | 12/2000 | Ng | |
| 6,186,604 | B1 | | 2/2001 | Fikse | |
| 6,203,126 | B1 | | 3/2001 | Harguth | |
| 6,260,501 | B1 | | 7/2001 | Agnew | |
| 6,263,989 | B1 | | 7/2001 | Won | |
| 6,264,293 | B1 | | 7/2001 | Musselman | |
| 6,264,294 | B1 | | 7/2001 | Musselman et al. | |
| 6,281,489 | B1 | | 8/2001 | Tubel et al. | |
| 6,323,615 | B1 | | 11/2001 | Khairallah | |
| 6,325,749 | B1 | | 12/2001 | Inokuchi et al. | |
| 6,333,631 | B1 | | 12/2001 | Das et al. | |
| 6,339,993 | B1 | | 1/2002 | Comello | |
| 6,380,889 | B1 | | 4/2002 | Herrmann et al. | |
| 6,394,204 | B1 | | 5/2002 | Haringer | |
| 6,405,798 | B1 | | 6/2002 | Barrett et al. | |
| 6,408,224 | B1 | | 6/2002 | Okamoto | |
| 6,411,055 | B1 | | 6/2002 | Fujita | |
| 6,422,509 | B1 | | 7/2002 | Yim | |
| 6,430,475 | B2 | | 8/2002 | Okamoto | |
| 6,431,296 | B1 | | 8/2002 | Won | |
| 6,446,718 | B1 | | 9/2002 | Barrett et al. | |
| 6,450,104 | B1 | | 9/2002 | Grant | |
| 6,477,444 | B1 | | 11/2002 | Bennett et al. | |
| 6,484,083 | B1 | | 11/2002 | Hayward | |
| 6,488,306 | B1 | | 12/2002 | Shirey et al. | |

| | | | |
|---|---|---|---|
| 6,505,896 | B1 | 1/2003 | Boivin |
| 6,512,345 | B2 | 1/2003 | Borenstein |
| 6,523,629 | B1 | 2/2003 | Buttz |
| 6,529,806 | B1 | 3/2003 | Licht |
| 6,535,793 | B2 | 3/2003 | Allard |
| 6,540,310 | B1 | 4/2003 | Cartwright |
| 6,557,954 | B1 | 5/2003 | Hattori |
| 6,563,084 | B1 | 5/2003 | Bandy et al. |
| 6,574,958 | B1 | 6/2003 | Macgregor |
| 6,576,406 | B1 | 6/2003 | Jacobsen et al. |
| 6,595,812 | B1 | 7/2003 | Haney |
| 6,610,007 | B2 | 8/2003 | Belson et al. |
| 6,619,146 | B2 | 9/2003 | Kerrebrock |
| 6,636,781 | B1 | 10/2003 | Shen et al. |
| 6,651,804 | B2 | 11/2003 | Thomas |
| 6,652,164 | B2 | 11/2003 | Stiepel et al. |
| 6,668,951 | B2 | 12/2003 | Won |
| 6,708,068 | B1 | 3/2004 | Sakaue |
| 6,715,575 | B2 | 4/2004 | Karpik |
| 6,725,128 | B2 | 4/2004 | Hogg et al. |
| 6,772,673 | B2 | 8/2004 | Seto |
| 6,773,327 | B1 | 8/2004 | Felice |
| 6,774,597 | B1 | 8/2004 | Borenstein |
| 6,799,815 | B2 | 10/2004 | Krishnan |
| 6,820,653 | B1 | 11/2004 | Schempf |
| 6,831,436 | B2 | 12/2004 | Gonzalez |
| 6,835,173 | B2 | 12/2004 | Couvillon, Jr. |
| 6,837,318 | B1 | 1/2005 | Craig |
| 6,840,588 | B2 | 1/2005 | Deland |
| 6,866,671 | B2 | 3/2005 | Tierney |
| 6,870,343 | B2 | 3/2005 | Borenstein |
| 6,917,176 | B2 | 7/2005 | Schempf |
| 6,923,693 | B2 | 8/2005 | Borgen |
| 6,936,003 | B2 | 8/2005 | Iddan |
| 6,959,231 | B2 | 10/2005 | Maeda |
| 7,020,701 | B1 | 3/2006 | Gelvin et al. |
| 7,040,426 | B1 | 5/2006 | Berg |
| 7,044,245 | B2 | 5/2006 | Anhalt et al. |
| 7,069,124 | B1 | 6/2006 | Whittaker et al. |
| 7,090,637 | B2 | 8/2006 | Danitz |
| 7,137,465 | B1 | 11/2006 | Kerrebrock |
| 7,144,057 | B1 | 12/2006 | Young et al. |
| 7,171,279 | B2 | 1/2007 | Buckingham et al. |
| 7,188,473 | B1 | 3/2007 | Asada |
| 7,188,568 | B2 | 3/2007 | Stout |
| 7,228,203 | B2 | 6/2007 | Koselka et al. |
| 7,235,046 | B2 | 6/2007 | Anhalt et al. |
| 7,331,436 | B1 | 2/2008 | Pack et al. |
| 7,387,179 | B2 | 6/2008 | Anhalt et al. |
| 7,415,321 | B2 | 8/2008 | Okazaki et al. |
| 7,475,745 | B1 | 1/2009 | DeRoos |
| 7,539,557 | B2 | 5/2009 | Yamauchi |
| 7,546,912 | B1 | 6/2009 | Pack et al. |
| 7,597,162 | B2 | 10/2009 | Won |
| 7,600,592 | B2 | 10/2009 | Goldenberg et al. |
| 7,645,110 | B2 | 1/2010 | Ogawa et al. |
| 7,654,348 | B2 | 2/2010 | Ohm et al. |
| 7,775,312 | B2 | 8/2010 | Maggio |
| 7,798,264 | B2 | 9/2010 | Hutcheson et al. |
| 7,843,431 | B2 | 11/2010 | Robbins et al. |
| 7,860,614 | B1 | 12/2010 | Reger |
| 7,974,736 | B2 | 7/2011 | Morin et al. |
| 2001/0037163 | A1 | 11/2001 | Allard |
| 2002/0128714 | A1 | 9/2002 | Manasas et al. |
| 2002/0140392 | A1 | 10/2002 | Borenstein |
| 2003/0000747 | A1 | 1/2003 | Sugiyama |
| 2003/0069474 | A1 | 4/2003 | Couvillon, Jr. |
| 2003/0097080 | A1 | 5/2003 | Esashi |
| 2003/0110938 | A1 | 6/2003 | Seto |
| 2003/0223844 | A1 | 12/2003 | Schiele |
| 2004/0030571 | A1 | 2/2004 | Solomon |
| 2004/0099175 | A1 | 5/2004 | Perrot et al. |
| 2004/0103740 | A1 | 6/2004 | Townsend |
| 2004/0168837 | A1 | 9/2004 | Michaud |
| 2004/0216931 | A1 | 11/2004 | Won |
| 2004/0216932 | A1 | 11/2004 | Giovanetti |
| 2005/0007055 | A1 | 1/2005 | Borenstein et al. |
| 2005/0027412 | A1 | 2/2005 | Hobson |
| 2005/0085693 | A1 | 4/2005 | Belson et al. |
| 2005/0107669 | A1 | 5/2005 | Couvillon, Jr. |
| 2005/0166413 | A1 | 8/2005 | Crampton |
| 2005/0168068 | A1 | 8/2005 | Courtemanche et al. |
| 2005/0168070 | A1 | 8/2005 | Dandurand |
| 2005/0225162 | A1 | 10/2005 | Gibbins |
| 2005/0235898 | A1 | 10/2005 | Hobson |
| 2005/0235899 | A1 | 10/2005 | Yamamoto |
| 2005/0288819 | A1 | 12/2005 | de Guzman |
| 2006/0000137 | A1 | 1/2006 | Validvia et al. |
| 2006/0005733 | A1 | 1/2006 | Rastegar et al. |
| 2006/0010702 | A1 | 1/2006 | Roth |
| 2006/0070775 | A1 | 4/2006 | Anhalt |
| 2006/0156851 | A1 | 7/2006 | Jacobsen |
| 2006/0225928 | A1 | 10/2006 | Nelson |
| 2006/0229773 | A1 | 10/2006 | Peretz |
| 2007/0029117 | A1 | 2/2007 | Goldenberg et al. |
| 2007/0156286 | A1 | 7/2007 | Yamauchi |
| 2007/0193790 | A1 | 8/2007 | Goldenberg et al. |
| 2007/0260378 | A1 | 11/2007 | Clodfelter |
| 2008/0115687 | A1 | 5/2008 | Gal et al. |
| 2008/0164079 | A1* | 7/2008 | Jacobsen ..... 180/7.1 |
| 2008/0168070 | A1 | 7/2008 | Naphade |
| 2008/0215185 | A1 | 9/2008 | Jacobsen |
| 2008/0272647 | A9 | 11/2008 | Hirose et al. |
| 2008/0284244 | A1 | 11/2008 | Hirose et al. |
| 2009/0035097 | A1 | 2/2009 | Loane |
| 2009/0171151 | A1 | 7/2009 | Choset et al. |
| 2010/0030377 | A1 | 2/2010 | Unsworth |

FOREIGN PATENT DOCUMENTS

| | | |
|---|---|---|
| CN | 1603068 | 4/2005 |
| CN | 2774717 | 4/2006 |
| CN | 1970373 | 5/2007 |
| CN | 101583820 | 5/2011 |
| DE | 3025840 | 2/1982 |
| DE | 3626238 | 2/1988 |
| DE | 19617852 | 10/1997 |
| DE | 19714464 | 10/1997 |
| DE | 19704080 | 8/1998 |
| DE | 10018075 | 1/2001 |
| DE | 102004010089 | 9/2005 |
| EP | 0105418 | 4/1984 |
| EP | 0584520 | 3/1994 |
| EP | 0818283 | 1/1998 |
| EP | 0924034 | 6/1999 |
| EP | 1444043 | 8/2004 |
| EP | 1510896 | 3/2005 |
| EP | 1832501 | 9/2007 |
| EP | 1832502 | 9/2007 |
| FR | 2638813 | 5/1990 |
| FR | 2850350 | 7/2004 |
| GB | 1199729 | 7/1970 |
| JP | 52 57625 | 5/1977 |
| JP | 58-89480 | 5/1983 |
| JP | 60015275 | 1/1985 |
| JP | 60047771 | 3/1985 |
| JP | 60060516 | 4/1985 |
| JP | 60139576 | 7/1985 |
| JP | 61001581 | 1/1986 |
| JP | 61089182 | 5/1986 |
| JP | 63306988 | 12/1988 |
| JP | 04092784 | 3/1992 |
| JP | 05147560 | 6/1993 |
| JP | 06-115465 | 4/1994 |
| JP | 03535508 | 6/2004 |
| JP | 2005111595 | 4/2005 |
| WO | WO 97/26039 | 7/1997 |
| WO | WO 00/10073 | 2/2000 |
| WO | WO 02/16995 | 2/2002 |
| WO | WO 03/030727 | 4/2003 |
| WO | WO 03037515 | 5/2003 |
| WO | WO 2005/018428 | 3/2005 |
| WO | WO 2006068080 | 6/2006 |
| WO | WO 2008/049050 | 4/2008 |
| WO | WO 2008/076194 | 6/2008 |
| WO | WO 2008/135978 | 11/2008 |
| WO | WO 2009/009673 | 1/2009 |

OTHER PUBLICATIONS

U.S. Appl. No. 12/151,730; filed May 7, 2008; Stephen C. Jacobsen; Office Action Issued Nov. 15, 2010.
U.S. Appl. No. 12/171,144; filed Jul. 10, 2008; Stephen C. Jacobsen; Office Action Issued Aug. 11, 2010.
U.S. Appl. No. 11/985,324; filed Nov. 12, 2007; Stephen C. Jacobsen; Office Action Issued Nov. 1, 2010.
PCT/US10/38331; filed Jun. 11, 2009; Stephen C. Jacobsen; ISR Issued Dec. 1, 2010.
U.S. Appl. No. 12/820,881; filed Jun. 22, 2010; Stephen C. Jacobsen; office action issued Nov. 30, 2010.
Iagnemma, Karl et al., "Traction control of wheeled robotic vehicles in rough terrain with application to planetary rovers." International Journal of Robotics Research, Oct.-Nov. 2004, pp. 1029-1040, vol. 23, No. 10-11.
Hirose, et al., "Snakes and strings; new robotic components for rescue operations," International Journal of Robotics Research, Apr.-May 2004, pp. 341-349, vol. 23, No. 4-5.
Braure, Jerome, "Participation to the construction of a salamander robot: exploration of the morphological configuration and the locomotion controller", Biologically Inspired Robotics Group, master thesis, Feb. 17, 2004, pp. 1-46.
Jacobsen, et al., Advanced intelligent mechanical sensors (AIMS), Proc. IEEE Trandsucers, Jun. 24-27, 1991, abstract only, San Fransico, CA.
Jacobsen, et al., "Multiregime MEMS sensor networks for smart structures," Procs. SPIE 6th Annual Inter. Conf. on Smart Structues and Materials, Mar. 1-5, 1999, pp. 19-32, vol. 3673, Newport Beach CA.
MacLean et al., "A digital MEMS-based strain gage for structural health monitoring," Procs. 1997 MRS Fall Meeting Symposium, Nov. 30-Dec. 4, 1997, pp. 309-320, Boston Massachusetts.
Berlin et al., "MEMS-based control of structural dynamic instability", Journal of Intelligent Material Systems and Structures, Jul. 1998 pp. 574-586, vol. 9.
Goldfarb, "Design and energetic characterization of a liquid-propellant-powered actuator for self-powered robots," IEEE Transactions on Mechatronics, Jun. 2003, vol. 8 No. 2.
Dowling, "Limbless Locomotion: Learning to crawl with a snake robot," The Robotics Institute at Carnegie Mellon University, Dec. 1997, pp. 1-150.
Jacobsen, Stephen, U.S. Appl. No. 11/985,320, filed Nov. 13, 2007; published as US-2008-0215185-A1; published Sep. 4, 2008.
Jacobsen, Stephen, U.S. Appl. No. 11/985,346, filed Nov. 13, 2007; published as US-2008-0136254-A1; published Jun. 12, 2008.
Jacobsen, Stephen, U.S. Appl. No. 11/985,324, filed Nov. 13, 2007; published as US-2008-0217993-A1; Published Sep. 11, 2008.
Jacobsen, Stephen, U.S. Appl. No. 11/985,323, filed Nov. 13, 2007; published as US-2008-0164079-A1; published Jul. 10, 2008.
Jacobsen, Stephen, U.S. Appl. No. 12/171,144, filed Jul. 10, 2008; published as US2009-0030562-A1; published Jan. 29, 2009.
Jacobsen, Stephen, U.S. Appl. No. 12/171,146, filed Jul. 10, 2008; published as US2009-0030562-A1; published Jan. 29, 2009.
Jacobsen, Stephen, U.S. Appl. No. 12/151,730, filed May 7, 2008; published as US2008-0281231-A1; published Nov. 13, 2008.
Jacobsen, Stephen, U.S. Appl. No. 12/117,233, filed May 8, 2008; published as US-2008-0281468-A1; published Nov. 13, 2008.
Jacobsen, Stephen, U.S. Appl. No. 11/293,701, filed Dec. 1, 2005; published as US-2006-0156851-A1; published Jul. 20, 2006.
Jacobsen, Stephen, U.S. Appl. No. 11/985,336, filed Nov. 13, 2007; published as US-2008-0167752-A1; published Jul. 10, 2008.
Jacobsen, Stephen, U.S. Appl. No. 12/350,693, filed Jan. 8, 2009; published as US-2010-0174422; published Jul. 8, 2010.
Jacobsen, Stepen, U.S. Appl. No. 12/694,996, filed Jan. 27, 2010; published as US-2010-0201187-A1; published Aug. 12, 2010.
Jacobsen, Stephen; U.S. Appl. No. 12/820,881; filed Jun. 22, 2010; published as US-2010-0258365-A1; Published Oct. 14, 2010.
Jacobsen, Stephen; U.S. Appl. No. 12/765,618; filed Apr. 22, 2010; published as US-2010-0201185-A1; published Aug. 12, 2010.
Jacobsen, Stephen; Patent Application No. 12/814,304; filed Jun. 11, 2010; published as US-2010-0318242-A1; published Dec. 16, 2010.
Matthew Heverly & Jaret Matthews: "A wheel-on-limb rover for lunar operation" Internet article, Nov. 5, 2008, pp. 1-8, http://robotics.estec.esa.int/i-SAIRAS/isairas2008/Proceedings/SESSION%2026/m116-Heverly.pdf.
NASA: "Nasa's newest concept vehicles take off-roading out of this world" Internet article, Nov. 5, 2008, http://www.nasa.gov/mission_pages/constellation/main/lunar_truck.html.
Revue Internationale De defense, "3-D vision and urchin" Oct. 1, 1988, p. 1292, vol. 21, No. 10, Geneve CH.
Advertisement, International Defense review, Jane's information group, Nov. 1, 1990, p. 54, vol. 23, No. 11, Great Britain.
Ren Luo "Development of a multibehavior-based mobile robot for remote supervisory control through the internet" IEEE/ ASME Transactions on mechatronics, IEEE Service Center, Piscataway, NY, Dec. 1, 2000, vol. 5, No. 4.
Nilas Sueset et al., "A PDA-based high-level human-robot interaction" Robotics, Automation and Mechatronics, IEEE Conference Singapore, Dec. 1-3, 2004, vol. 2, pp. 1158-1163.
U.S. Appl. No. 12/171,144; filing date Jul. 10, 2008; Stephen C. Jacobsen; office action mailed Jan. 13, 2011.
U.S. Appl. No. 12/694,996; filing date Jan. 27, 2010; Stephen C. Jacobsen; office action mailed Jan. 26, 2011.
PCT Application PCT/US2010/038339; filed Jun. 11, 2010; Stephen C. Jacobsen; ISR mailed Feb. 9, 2011.
U.S. Appl. No. 12/765,618; filed Apr. 22, 2010; Stephen C. Jacobsen; office action issued Apr. 6, 2011.
U.S. Appl. No. 11/985,320; filed Nov. 13, 2007; Stephen C. Jacobsen; office action issued Apr. 12, 2011.
U.S. Appl. No. 11/985,324; filed Nov. 13, 2007; Stephen C. Jacobsen; notice of allowance issued Apr. 18, 2011.
U.S. Appl. No. 12/151,730; filed May 7, 2008; Stephen C. Jacobsen; notice of allowance issued Apr. 15, 2011.
U.S. Appl. No. 11/985,336; filed Nov. 13, 2007; Stephen C. Jacobsen; office action issued Jun. 14, 2011.
U.S. Appl. No. 12/820,881; filed Jun. 22, 2010; Stephen C. Jacobsen; notice of allowance issued Jun. 9, 2011.
U.S. Appl. No. 11/985,320; filed Nov. 13, 2007; Stephen C. Jacobsen; office action mailed Aug. 17, 2011.
U.S. Appl. No. 12/765,618; filed Apr. 22, 2010; Stephen C. Jacobsen; office action issued Sep. 20, 2011.
U.S. Appl. No. 12/350,693; filed Jan. 8, 2009; Stephen C. Jacobsen; office action issued Oct. 12, 2011.
U.S. Appl. No. 12/985,320; filed Nov. 13, 2007; Stephen C. Jacobsen; office action issued Nov. 25, 2011.
U.S. Appl. No. 12/765,618; filed Apr. 22, 2010; Stephen C. Jacobsen; Notice of Allowance issued Feb. 2, 2012.
U.S. Appl. No. 12/171,146; filed Jul. 10, 2008; Stephen C. Jacobsen; office action issued Feb. 9, 2012.
U.S. Appl. No. 11/985,336; filed Nov. 13, 2007; Stephen C. Jacobsen; notice of allowance issued Jan. 19, 2012.
U.S. Appl. No. 12/350,693; filed Jan. 8, 2009; Stephen C. Jacobsen; office action issued Mar. 28, 2012.
U.S. Appl. No. 11/985,320; filed Nov. 13, 2007; Stephen C. Jacobsen; office action issued Apr. 25, 2012.
Mehling et al.; A Minimally Invasive Tendril Robot for In-Space Inspection; Feb. 2006; The First IEEE/RAS-EMBS International Conference on Biomedical Robotics and Biomechatronics (BioRob '06) pp. 690-695.
U.S. Appl. No. 13/181,380, filed Jul. 12, 2011; Stephen C. Jacobsen; office action issued Jul. 17, 2012.

* cited by examiner

AMPHIBIOUS ROBOTIC CRAWLER

RELATED APPLICATIONS

This application claims the benefit of U.S. Provisional Patent Application Ser. No. 61/186,289, filed Jun. 11, 2009, and entitled, "Amphibious Robotic Crawler," which is incorporated by reference in its entirety herein.

FIELD OF THE INVENTION

The present invention relates to small, unmanned ground vehicles (UGVs). More particularly, the present invention relates to an amphibious robotic crawler for traveling through a body of water.

BACKGROUND OF THE INVENTION AND RELATED ART

Robotics is an active area of research, and many different types of robotic vehicles have been developed for various tasks. For example, unmanned aerial vehicles have been quite successful in military aerial reconnaissance. Less success has been achieved with unmanned ground vehicles (UGVs), however, in part because the ground or surface environment is significantly more variable and difficult to traverse than the airborne environment.

Unmanned ground vehicles face many challenges when attempting mobility. Surface terrain can vary widely, including for example, loose and shifting materials, obstacles, or vegetation on dry land, which can be interspersed with aquatic environments such as rivers, lakes, swamps or other small bodies of water. A vehicle optimized for operation in one environment may perform poorly in other environments.

There are also tradeoffs associated with the size of vehicle. Large vehicles can handle some obstacles better, including for example steps, drops, gaps, and the like. On the other hand, large vehicles cannot easily negotiate narrow passages or crawl inside small spaces, such as pipes, and are more easily deterred by vegetation. Large vehicles also tend to be more readily spotted, and thus are less desirable for discrete surveillance applications. In contrast, while small vehicles are more discrete, surmounting obstacles becomes a greater mobility challenge.

A variety of mobility configurations have been adapted to travel through variable surface and aquatic environments. These options include legs, wheels, tracks, propellers, oscillating fins and the like. Legged robots can be agile, but use complex control mechanisms to move and achieve stability and cannot traverse deep water obstacles. Wheeled vehicles can provide high mobility on land, but limited propulsive capability in the water. Robots configured for aquatic environments can use propellers or articulating fin-like appendages to move through water, but which may be unsuitable for locomotion on dry land.

Options for amphibious robots configured for both land and water environments are limited. Robots can use water tight, land-based mobility systems and remain limited to shallow bodies of water. They can also be equipped with both land and water mobility devices, such as a set of wheels plus a propeller and rudder, but this adds to the weight, complexity and expense of the robot.

Another option is to equip the amphibious robot with a tracked system. Tracked amphibious vehicles are well-known and have typically been configured in a dual track, tank-like configuration surrounding a buoyant center body. However, the ground-configured dual tracks which are effective in propelling and turning the vehicle on the ground can provide only a limited degree of propulsion through water, and the vehicle's power system must often be over-sized in order to generate an acceptable amount of thrust when traveling in amphibious mode. Furthermore, the differential motion between the two treaded tracks cannot provide the vehicle with the same level of maneuverability and control in water as it does on land, dictating that additional control structures, such as a rudder, also be added to the vehicle for amphibious operations. Another drawback is that typical tracked amphibious vehicles also cannot operate submerged.

SUMMARY OF THE INVENTION

The present invention includes an amphibious robotic crawler which helps to overcome the problems and deficiencies inherent in the prior art. In one embodiment, the amphibious robotic crawler includes a first frame and a second frame, with each frame having a continuous track rotatably supported therein and coupled to a drive mechanism through a drive unit. The frames are positioned end-to-end, and coupled with an active, actuated, multi-degree of freedom linkage. Buoyancy control elements are disposed on the frames to allow the crawler to operate either at the surface of the water or submerged. Propulsion is provided by the engagement of the continuous tracks with the water, while direction and attitude is controlled by bending or twisting the actuated linkage arm to position the first and second frames at an angle with respect to each other, which causes the crawler to turn, pitch or roll as it travels through the water. The continuous tracks can further be configured with a propulsive-enhancing tread which provides an asymmetric thrust between the top and bottom surfaces of the tracks, to provide enhanced mobility while traveling through the water.

BRIEF DESCRIPTION OF THE DRAWINGS

Features and advantages of the invention will be apparent from the detailed description that follows, which taken in conjunction with the accompanying drawings, together illustrate features of the invention. It is understood that these drawings merely depict exemplary embodiments of the present invention and are not, therefore, to be considered limiting of its scope. And furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

Figure 1:
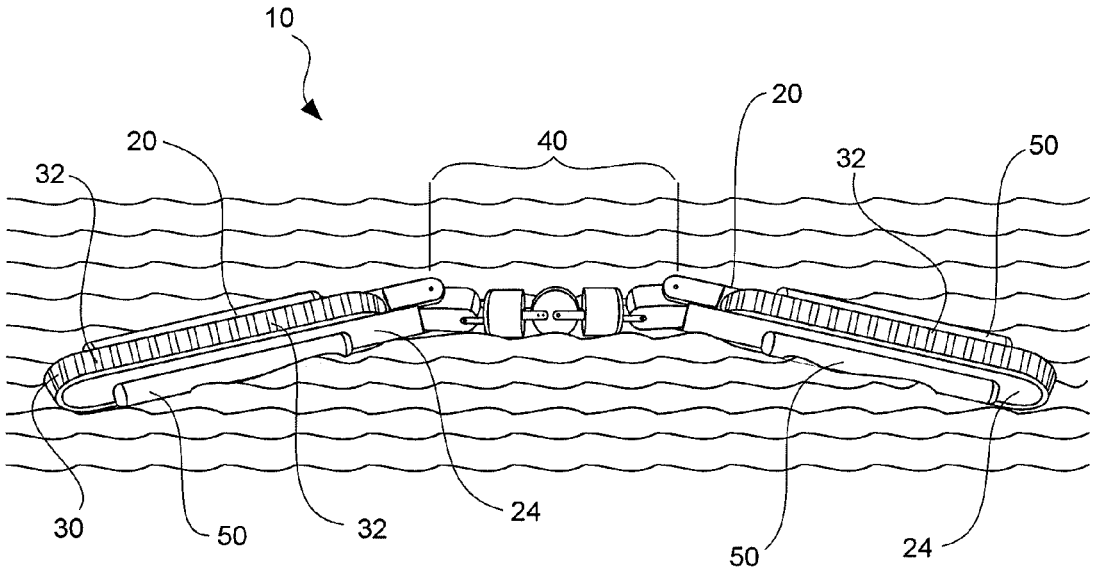
FIG. 1 illustrates a perspective top view of an amphibious robotic crawler operating near the surface of a body of water, according to an exemplary embodiment of the present invention.

The following detailed description of the invention makes reference to the accompanying drawings, which form a part thereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. As such, the following more detailed description of the embodiments of the present invention is not intended to limit the scope of the invention as it is claimed, but is presented for purposes of illustration only; to describe the features and characteristics of the present invention, and to sufficiently enable one skilled in the art to practice the invention. Accordingly, the scope of the present invention is to be defined solely by the appended claims.

Illustrated in FIGS. 1-6 are various exemplary embodiments of an amphibious robotic crawler that can travel a predetermined course over land and through a body of water. The amphibious robotic crawler is versatile, and can travel on dry land, through muddy or marshy terrain, on the surface of a body of water, or below the surface in a completely submerged fashion. In a basic configuration, the crawler can be configured with two or more frame units, with the different frame units having a continuous track rotatably supported or mounted thereon for rotating around a housing. The housing can be a water tight enclosure that contains its own power supply or fuel source, as well as a drive mechanism coupled to a drive unit that rotates the tracks. The housing can include an onboard control module which controls the various systems integrated into the crawler.

Each frame unit can include buoyancy control elements extending out from either side of the housing to provide sufficient positive buoyancy to stably float the crawler on the surface, or to maintain a neutral buoyancy that allows the crawler to operate suspended within the body of water. The buoyancy control elements can be configured with separate compartments which can be individually inflated with a buoyant material, to provide additional control over the pose of the crawler as it moves through the water.

The crawler propels itself both on land and through water by activating the drive mechanisms to turn the drive units that rotate the continuous tracks around the housings, while at the same time selectively engaging one portion of track surface with the adjacent surface or medium. When operating on land, the engaged portion of the track is the lower track section in contact with the ground. When operating in water, the engaged portion of the track can be the lower track section if the crawler is floating at the surface of the body of water, or an uncovered track section if the track section on the opposite side is covered.

In another aspect of the present invention the continuous track can be configured with an asymmetric propulsive-enhancing tread which provides an asymmetric thrust between the top and bottom surfaces of the tracks, to provide enhanced mobility while traveling through the water. The asymmetric thrust can be generated by tread elements that extend outwards into the water when a particular section of the continuous track is moving rearward through the water, and which fold or retract when that same section is moving forward through the water. As the continuous tracks can be rotated in both directions about the frame unit, the tread elements can also be configured to extend during travel over either the top or bottom surfaces of the tracks.

In another representative embodiment of the present invention, the crawler can propel itself through the water with an auxiliary thrust system, such as a propeller system or water jet, etc. The auxiliary thrust system can be mounted into a thrust pod supported on movable arms, which can then be lifted up out of the way or discarded when the crawler moves from the water to operation on the ground.

The frame units are connected by a multi-degree of freedom linkage which is actively actuated to move and secure the two or more frame units into various orientations or poses with respect to each other. The actuated linkage provides controllable bending about at least two axes, and can include a steering mechanism which allows the crawler to steer itself while moving through the body of water. Bending the linkage re-aligns the thrust vectors of the propulsive forces generated by the rotating tracks and causes the crawler to pivot around its center of mass and change direction or depth. The linkage arm can bend in any direction to guide the crawler from side-to-side or to a deeper or shallower depth within the body of water. The crawler can also steer itself by rotating the tracks on the two frame units at different speeds, creating a thrust differential that can turn the crawler.

Also disclosed in the present invention is a method and system for operating a segmented robotic crawler through a body of water, in which the onboard control module can be configured to coordinate the buoyancy of the buoyancy control elements, the rotation of the at least two tracks, and the bending of the at least one linkage arm to direct the crawler along a predetermined course and at a predetermined depth through the water.

The following detailed description and exemplary embodiments of the amphibious robotic crawler will be best understood by reference to the accompanying drawings, wherein the elements and features of the invention are designated by numerals throughout.

Illustrated in FIG. 1 is an exemplary embodiment of an amphibious robotic crawler 10 that can travel a predetermined course over land, through water and combinations thereof. In its basic configuration, the crawler can be assembled with two amphibious frame units 20 operatively connected (e.g., in tandem) by an actuated linkage arm 40, with both frame units having a continuous track 30 rotatably supported or mounted thereon for rotation around a housing 24. The continuous track can include a plurality of track elements or tread elements 32. The housing may comprise a water tight enclosure that contains its own power supply or fuel source, as well as a drive mechanism coupled to a drive unit that rotates the tracks. The housing can also contain an onboard control module for controlling the various systems integrated into the crawler. Although shown in the drawings with just two frame units and one actuated linkage arm, other configurations of the amphibious robotic crawler can include additional frame units and linkage arms, and are also considered to fall within the scope of the present invention.

A power supply or power source for the robotic crawler can be contained within one or both of the frame units (e.g., within the housing), or it can be a separate module integrated into the robotic device, such as a module within the linkage.

The actuated linkage arm 40 can include a steering mechanism which allows the crawler to steer itself while moving through the body of water by providing controllable bending about at least two axes. Bending the linkage re-aligns the thrust vectors of the propulsive forces generated by the rotating tracks and causes the crawler to pivot around its center of mass and change direction or depth. The linkage arm can bend in any direction to guide the crawler from side-to-side or to a deeper or shallower depth within the body of water. Configuring the frame units end-to-end, or in a "train" mode, and using the actuated linkage arm to steer the amphibious robotic crawler through adjustment of the thrust vectors provided by the rotating tracks gives the present invention a high degree of maneuverability and mobility in aquatic settings. And as will be discussed further below, the frame units can also be configured side-to-side, or in a "tank" mode, by the actuated linkage arm. In tank mode the crawler can experience increased the maneuverability through the water by adjusting the relative pitch (e.g. the up and down angle) between the two frame units.

It is understood that the scope of the present invention can extend to actuated linkage arms that provide controllable bending about three or more axes. The multi degree of freedom actuated linkage arm 40 shown in FIG. 2, for example, can include joints providing bending about seven different axes. The multiple degree of freedom linkage arm includes a first wrist-like actuated linkage coupled to the first frame, a second wrist-like actuated linkage coupled to the second frame, and an elbow-like actuated joint coupled between the first and second wrist-like actuated linkages. Two yaw joints 42 provide bending about a yaw axis, two pitch joints 44 provide bending about a pitch axis, two rotary or roll joints 46 provide rotation about a roll axis, and one additional bending joint 48 provides rotation about a translatable axis. This particular arrangement of frames and joint units provides significant flexibility in the poses that the mobile robotic device can assume. For example, commonly-owned and co-pending U.S. patent application Ser. No. 11/985,323, filed Nov. 13, 2007, and entitled "Serpentine Robotic Crawler", which is incorporated by reference herein, describes various systems, poses and movements enabled by this particular arrangement of joints and frame units.

Referring back to both FIGS. 1 and 2, the basic configuration of the amphibious robotic crawler, with the two frame units 20 connected by one actuated linkage arm 40 as shown, can allow for a highly maneuverable robotic reconnaissance system with a small size to better avoid detection. It will be appreciated, however, that various other arrangements of a mobile amphibious robotic crawler can be used, and the invention is not limited to this particular arrangement. For instance, nothing should be construed from the drawings or specification to preclude expanding the robotic crawler in a modular fashion to include three or more frame units and additional linkage arms as needed. The additional modules can be added to carry extra fuel in order to expand the crawlers area of operation, to transport a deployable surveillance package, or to support a specialized crawler module not otherwise configured for amphibious operation, etc.

Each amphibious frame unit 20 can include buoyancy control elements 50 that can extend out from the sides of the housing 24 and that are configured to provide sufficient control of the buoyancy of the robotic crawler within the water (e.g., to float the amphibious robotic crawler 10 on the surface of the body of water or cause it to ascend, to cause the robotic crawler to descend or sink, or to maintain or suspend the robotic crawler in a neutral position submerged below the surface of the water).

Two buoyancy control elements can be used, one on each side of the housing, to stably support each frame unit in the middle. Furthermore, the degree of buoyancy provided by the buoyancy control elements can be selectively adjusted via the control module located within the housing. The degree of buoyancy can include generating a net positive buoyancy to allow the robotic crawler to ascend within or float to the top of the water. In another aspect, the degree of buoyancy can include generating a negative buoyancy that enables the crawler to descend within or sink towards the bottom of the water, in some cases at a rate faster than if left to descend under its own weight. In still another aspect, the degree of buoyancy can include establishing a neutral buoyancy that causes the robotic crawler to remain suspended at a certain or steady depth within the body of water.

In some embodiments, it is contemplated that the robotic crawler may possess sufficient buoyancy characteristics to float on a body of water without requiring an additional buoyancy element. In such a configuration, operation submerged underwater may be facilitated by a negative buoyancy control element operable with the robotic crawler. For example, the buoyancy control elements 50 shown in FIG. 1 may be negative buoyancy control elements, or they may comprise buoyancy control elements that provide a positive, neutral and/or negative buoyancy function, as desired. Rather than filling the cavities of the buoyancy control elements with something that will contribute to the buoyancy of the robotic crawler, the cavities of the buoyancy control elements may be filled with a fluid or other substance (e.g., water) that will detract from the overall buoyancy of the robotic crawler, and that may even facilitate a rapid descent of the robotic crawler through the water. Still further, causing a robotic crawler that normally floats on the water to sink may include filling other gas filled chambers or cavities that exist in the robotic crawler with a fluid or other substance in order to reduce the elements contributing to or causing the floatation of the robotic crawler.

In some embodiments, the buoyancy control elements 50 can be rigid, water-tight containers attached to the sides of the housings 24, or inflatable containers that inflate outwardly for operation in the water and retract back into the housings when the crawler is operating on land. The positive buoyant material filling the buoyancy control elements can comprise any gas, liquid or solid which can displace a greater amount of water than its own weight, and can include a foam, pressurized air, a fuel gas derived from a phase change of a fuel source or a product gas derived from a chemical reaction between two or more reactants, etc. Negative buoyant materials may include water or any other fluid or substance that does not displace a greater amount of water than under its own weight.

Figure 2:
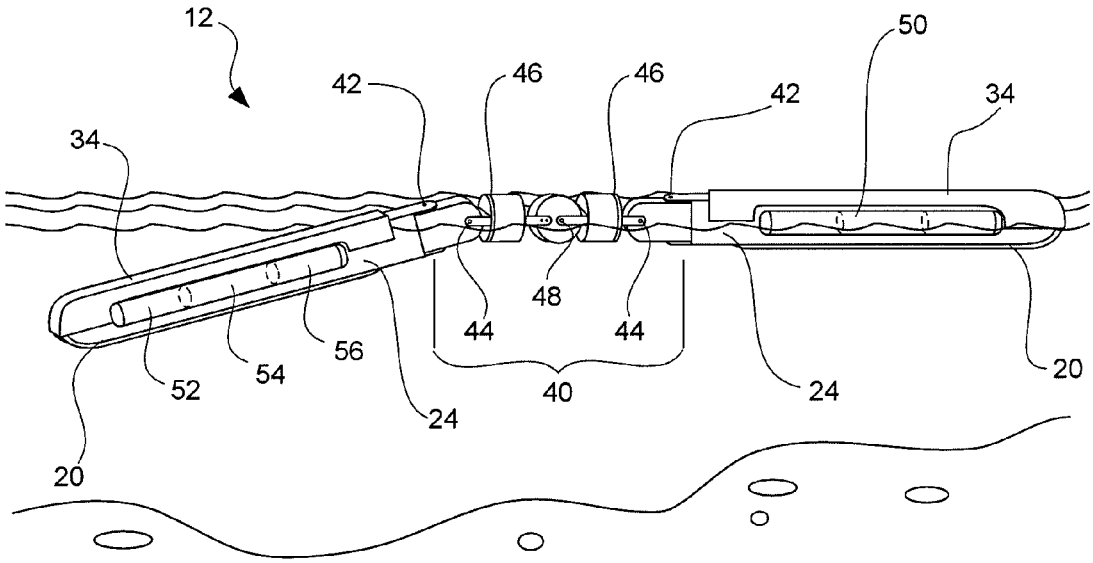
FIG. 2 illustrates a perspective side view of an amphibious robotic crawler operating near the surface of a body of water, according to another exemplary embodiment of the present invention.

In one aspect of the present invention, the buoyancy control elements 50 can be provided with two or more separate compartments 52, 54, 56 which can be individually inflated with a buoyant material to provide additional control over the pose or trim of the crawler as it moves through the water. As illustrated in FIG. 2, if forward compartment 56 is inflated to a greater degree than rearward compartment 52, the frame unit will tend to assume a nose-up attitude while traveling through the water. In another aspect, the buoyancy control elements 50 can be a mission configurable option which is releasably attached to the frame units 20 before introducing the crawler 10 into the amphibious environment. This permits the buoyancy control elements to be detached after transitioning from water to land to facilitate greater maneuverability of the crawler as it subsequently traverses ground terrain and obstacles.

As discussed hereinabove, each water-tight housing 24 can include an onboard control module comprising electronic hardware and downloadable software which controls the various systems integrated into the amphibious robotic crawler 10, including but not limited to the drive mechanisms for rotating the continuous tracks 30 and the steering mechanism in the actuated linkage arm 40 that provides controllable bending about at least two axes. The buoyancy and attachment of the buoyancy control elements 50 can also be managed by the control modules.

It can be appreciated that propelling a vehicle with a continuous track requires that just one track surface be substantially engaged with the medium upon or through which the vehicle is traveling. During locomotion over land, for instance, only the lower track section engages with the ground, resulting in a net forward movement of the vehicle. In aquatic environments, however, both upper and lower track sections can be exposed to the water, with the possible outcome of zero net forward movement if both surfaces become substantially engaged with the fluid. Consideration must be made, therefore, to ensure that only one track surface of an amphibious vehicle is exposed to and substantially engages the water when traveling through an aquatic environment, or that the tread elements on the track are selectively activated and deactivated.

In the present invention, the buoyancy modules 50 and the continuous track 30 can be configured together to define how the track surfaces engage with the surrounding water to propel the crawler forward. In one aspect of the present invention, for instance, track surfaces can be selectively engaged by raising the top portion of the frame unit out of the water, as when traveling on the surface of the body of water (see FIG. 1). With the top surface of the track out of the water, the frame unit is driven forward as the tread elements on the bottom track surface advance backwards through and push against the water beneath the frame unit.

In the embodiment 12 of the present invention illustrated in FIG. 2, one surface of the continuous track 30 can be covered with a shield 34 that prevents the water from contacting the covered section of the continuous track while selectively permitting the uncovered section to substantially engage the water. The shield 34 can also be a mission configurable option that is removably attached to the housing 24 of the frame unit 20 before introducing the crawler 10 into the amphibious environment, and can be discarded after the crawler transitions from water to land to facilitate greater maneuverability of the crawler as it subsequently traverses ground terrain and obstacles.

Figure 3:
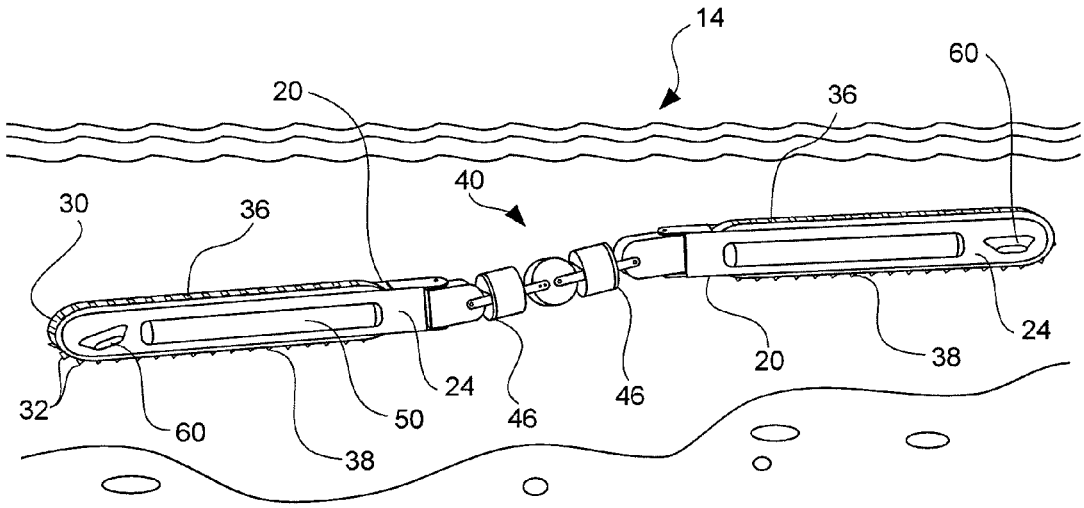
FIG. 3 illustrates a perspective side view of an amphibious robotic crawler operating submerged in a body of water while operating in a "train" configuration, according to another exemplary embodiment of the present invention.
Figure 4:
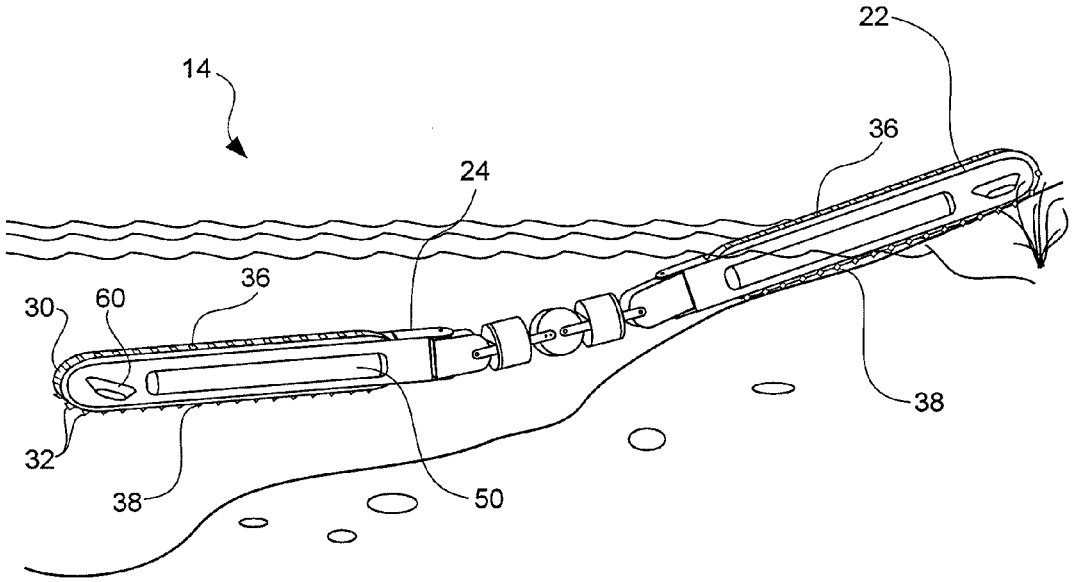
FIG. 4 illustrates a perspective side view of an amphibious robotic crawler operating on both land and water, in accordance with the embodiment of FIG. 3.

In another embodiment 14 of the present invention exemplified in FIGS. 3 and 4, the continuous track 30 can be provided with an asymmetric propulsion-enhancing tread which can provide an asymmetric thrust between the top and bottom surfaces of the tracks, to increase the mobility of the amphibious robotic crawler through the water. The asymmetric thrust can be generated by tread elements 32 that selectively extend outwards into the water when a particular section of the continuous track is moving rearward through the water, and which fold or retract when that same section is moving forward through the water. For example, the alternately extendable 38 and retractable (or foldable) 36 tread elements can be flaps, cups or small protrusions, etc.

The tread elements 32 can be configured to alternately retract (or fold) and extend (or unfold) outward in accordance with first and second directional movements of the continuous track. As illustrated in FIG. 3, for instance, the continuous tracks rotate around the housings 24 of both the frame units 20 in a clockwise direction, with the top track surfaces moving forward and the bottom track surfaces moving rearward. In this configuration, as the continuous track 30 moves through the water, the tread elements 32, once in position on the upper track surface, can move forward in a retracted or folded position (see retracted tread elements 36) to avoid substantial engagement with the water, even though the upper surface is still exposed and in contact with the water. Conversely, the tread elements 32, once in position on the lower track surface, can move backward in an extended (or unfolded) and protruding posture or position (see extended tread elements 38) to engage with the water and drive the frame units and the UGV forward.

A variety of methods and means can be employed to extend and retract or fold the tread elements 32. For instance, means for manipulating the treads about the track to be in an extended or unfolded state or a retracted or folded state may comprise a guide mechanism that can be positioned adjacent the continuous track to mechanically direct the tread elements to extend and retract or fold as they move around the housing. Alternatively, each tread element can be equipped with an individual electrical device, such as a linear motor, and linkage which extends and retracts the tread element in response to an electrical signal. A spring and latch mechanism could also be employed in which the tread elements are forced closed and latched as they round the back end of the frame unit and move forward along the upper surface, and are released to spring open during rearward travel along the bottom. The tread elements may also be configured to extend and retract in response to fluid pressure. It is to be appreciated that any mechanism for extending and retracting the tread elements, whether mechanical or electrical, can be considered to fall within the scope of the present invention.

As shown in FIG. 4, the continuous track 30 with alternately extendable 38 and retractable 36 tread elements 32 provides the benefit of allowing the amphibious robotic crawler to travel both submerged underwater and on land with the same track configuration. It is to be appreciated that submerged movement of the crawler 14 through a body of water can provide for improved concealment, as opposed to traveling on the water's surface. Moving underwater can allow the crawler to move about undetected until a forward frame unit 22 contacts the shore and emerges from the water, even while a rear frame unit 24 remains submerged. The forward frame unit can be equipped with a sensor package (not shown) that allows it to conduct a quick surveillance of the surrounding environment and assess any potential threats before the entire crawler exits the water and becomes completely exposed.

When tasked and configured for submerged travel, as illustrated in FIGS. 3 and 4, the amphibious robotic crawler 14 can be further equipped with buoyancy control elements 50 and controllable planar surfaces 60, or diving planes, which provide for enhanced maneuverability underwater. In a standard orientation in which the frame units are aligned end-to-end and co-planer, the diving planes can pivot to direct the crawler up or down within the body of water. However, when used in conjunction with roll joints 46 of the actuated linkage arm 40, the frame units can be rotated or twisted relative to each other, putting the diving planes into a position of turning the crawler sideways in addition to vertical changes in direction. Thus, the diving planes can provide for enhanced steering and directional control when traveling underwater.

In another aspect, the controllable planar surfaces may be configured to function in a coordinated effort with the operation and movement of the continuous tracks to provide depth control to the crawler, potentially eliminating the need for separate buoyancy control elements or modules, or at least enabling their size to be somewhat reduced. In this configuration, however, movement of the crawler may have to be continuous to prevent sinking of the crawler. In other words, as long as the continuous tracks operated to continuously propel the crawler through the body of water, with the controllable planar surfaces acting as foils, the crawler would be able to maintain a desired depth.

Figure 5:
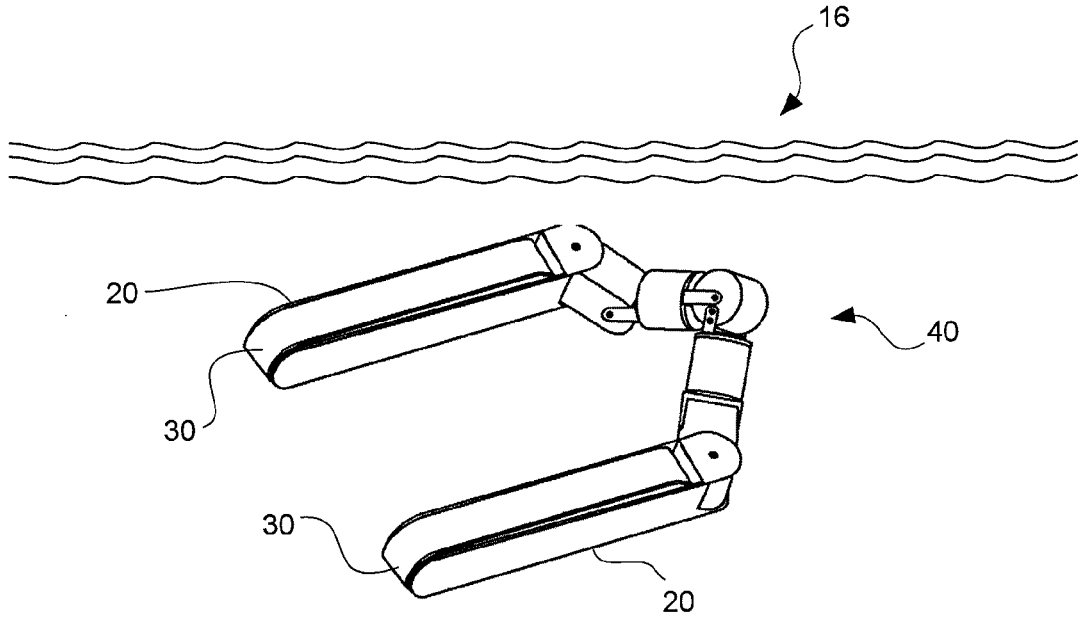
FIG. 5 illustrates a perspective side view of an amphibious robotic crawler operating submerged in a body of water while operating in a "tank" configuration, in accordance with the embodiment of FIG. 3.

As shown in FIG. 5, the frame units 20 can also be configured in a side-to-side orientation, or in a "tank" mode 16, by the actuated linkage arm 40 during underwater or surface operation. In tank mode it is possible to maneuver the crawler without the use of any other control surfaces. The two frame units 40 with propulsive continuous tracks 30 can be angled with respect to one another both in plane and out of plane, and the track speeds can be varied with respect to one another to provide significant steering as well. In another aspect the middle segments of the actuated linkage arm 40 could be provided with planar or curved control surfaces (not shown) that could be tilted up or down with respect to the plane defined by the tracks to cause the UGV to move upwards or downwards with respect the plane of the tracks. Since each segment of the actuated linkage arm is movable, the control surfaces could be fixed to follow along with the segment, or provided with their own actuation device for independent movement which could be used to steer the amphibious robotic crawler in any direction.

Figure 6:
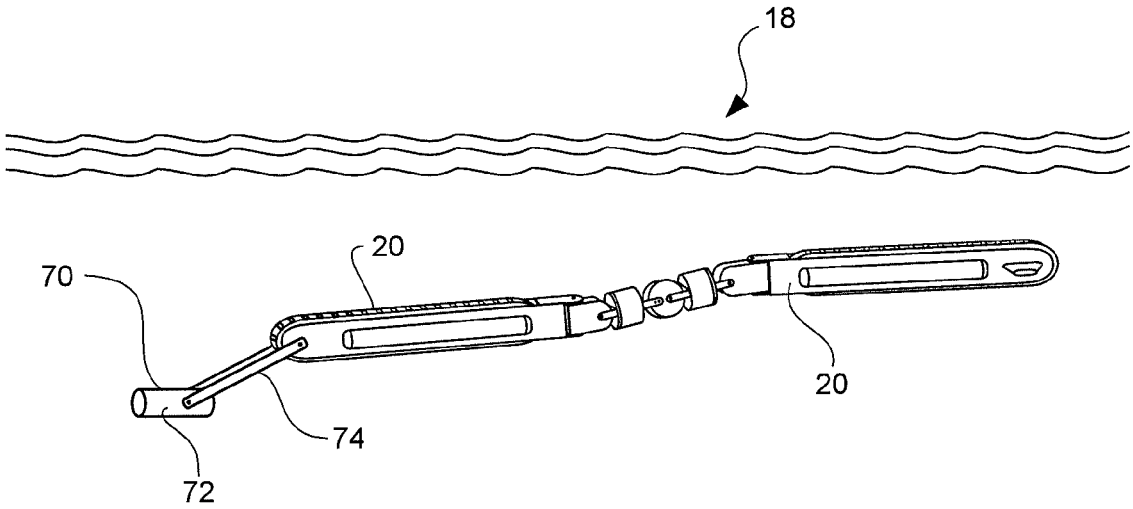
FIG. 6 a perspective side view of an amphibious robotic crawler operating submerged in a body of water with an auxiliary thrust device, according to another exemplary embodiment of the present invention.

In another representative embodiment 18 illustrated in FIG. 6, the amphibious robotic crawler can be provided with an auxiliary thrust or propulsion module 70, such as a propeller system or water jet, etc. The auxiliary thrust system can be mounted into a thrust pod 72 supported on actuatable arms 74 deployed from a frame unit 20, which arms can rotated upward to a raised position to lift the thrust pod above the crawler as it moves over the ground. The arms can then rotate downwards during water operations to locate the thrust pod in a optimal orientation for propelling the crawler through the water. Like the buoyancy control elements described above, the propulsion modules can be detached and discarded after transitioning from water to land to facilitate greater maneuverability of the crawler as it subsequently traverses ground terrain and obstacles.

Figure 7:
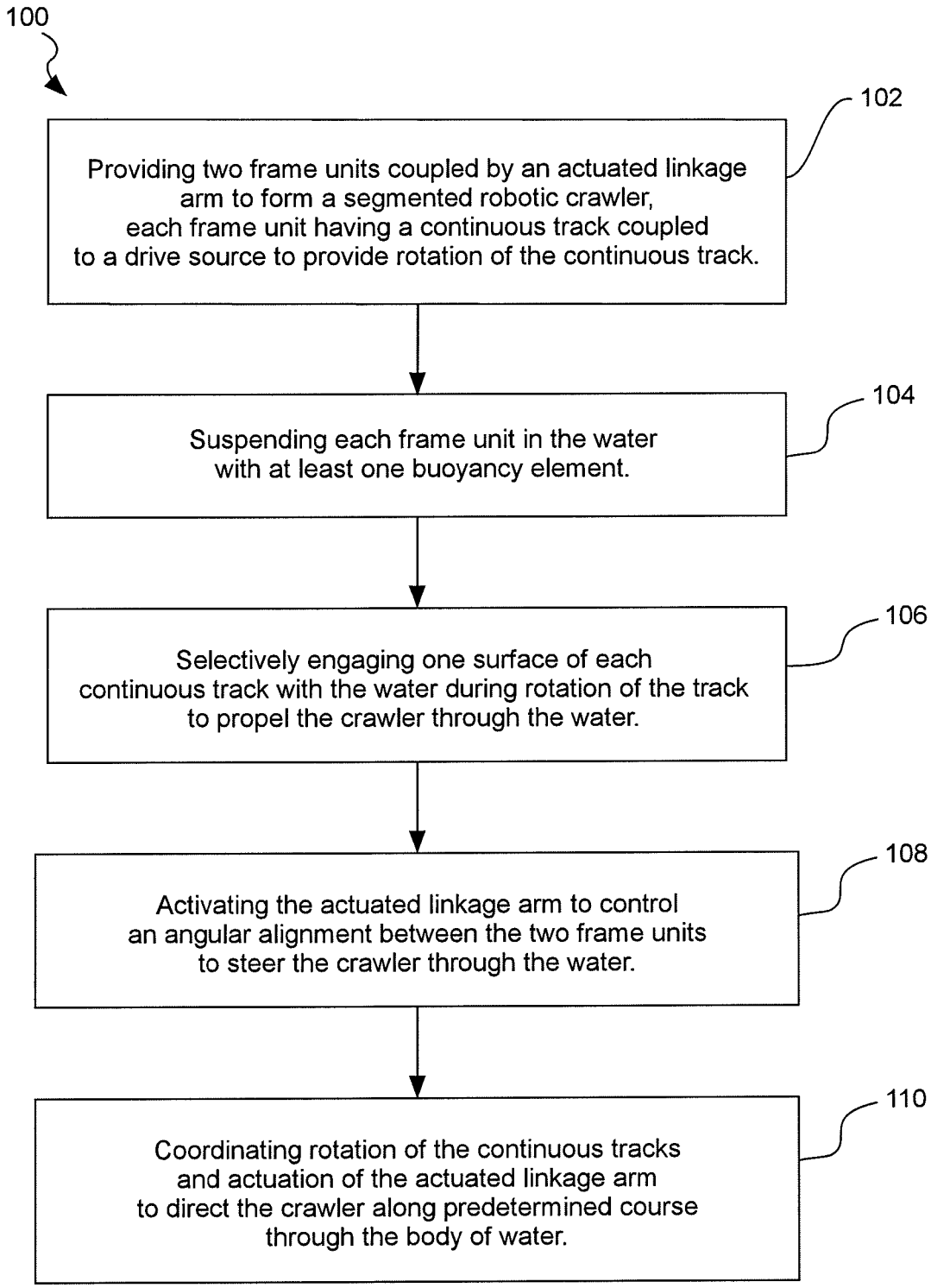
FIG. 7 is a flow chart of a method for operating a segmented robotic crawler through a body of water, according to an exemplary embodiment of the present invention.

FIG. 7 is a flow chart depicting a method 100 of operating a segmented robotic crawler through a body of water, which includes providing 102 a first robotic frame unit and second robotic frame unit coupled by an actuated multi-degree of freedom linkage arm to form a segmented robotic crawler. Each frame unit has a continuous track coupled to a drive mechanism through a drive unit to provide rotation of the continuous track.

The method 100 further includes the operation of suspending 104 each frame unit in the water with at least one buoyancy control element. The buoyancy control element can maintain sufficient positive buoyancy to stably float the frame unit on the surface, and can provide neutral buoyancy that allows the frame unit to operate submerged within the body of water.

The method 100 further includes the operation of selectively engaging 106 one surface of each continuous track with the body of water during rotation of the track to propel the crawler through the water. The engaged track surface can be the lower track section if the frame unit is floating at the surface of the body of water, an uncovered track section if the track section on the opposite side is covered, or a track section having extended tread elements if the track section on the opposite side has retracted tread elements.

The method 100 further includes the operation of activating 108 the actuated multi-degree of freedom linkage arm coupled between the first frame and the second frame to provide controllable bending about at least two axes to guide the crawler from side-to-side or to a deeper or shallower depth within the body of water. The actuated linkage arm can also include roll joints to provide controllable rotation of the first frame unit relative to the second frame unit, and which can be employed in combination with pivoting planar surfaces attached to each frame unit to provide enhanced maneuverability when traveling underwater.

The method 100 also includes the operation of coordinating 110 rotation of the continuous tracks and actuation of the multi-degree of freedom linkage arm to direct the crawler along a predetermined course through the body of water. The method can further include adjusting the buoyancy of each buoyancy control element to control the depth and pose of the crawler in the body of water. The propulsion, steering and buoyancy systems can be controlled by onboard control modules located inside the water-tight housings.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A segmented robotic crawler for traversing about or through a body of water comprising:

at least two frame units including a housing containing a drive mechanism;

a drivable, continuous track operable with each frame unit and rotatably supported around the housing, the track further comprising a plurality of tread elements, wherein at least one surface of the continuous track is exposed to enable engagement with the body of water;

a control module for guiding the robotic crawler in the body of water;

at least one drive unit coupled between the continuous track and the drive mechanism;

at least one actuated linkage arm coupled between the frame units to provide controllable bending about at least two axes; and at least one buoyancy control element disposed on the frame units adapted to control the buoyancy of the frame units in the body of water wherein the plurality of tread elements further comprise a plurality of extendable and one of retractable and foldable type tread elements, and wherein the tread elements one of retract and fold during travel in a first directional motion for disengagement from the water and extend during travel in a second directional motion for engagement with the water.

2. The segmented robotic crawler of claim 1, wherein the buoyancy control element is an inflatable receptacle configured to expand in an outward direction from the frame units.

3. The segmented robotic crawler of claim 1, wherein the buoyancy control elements comprises a plurality of separate compartments which can be individually filled with a buoyant material to provide additional control over the pose and trim of the robotic crawler as it moves through the body of water.

4. The segmented robotic crawler of claim 1, wherein the buoyancy control elements are retractably supported about the frame units.

5. The segmented robotic crawler of claim 2, wherein the inflatable receptacle is filled with a buoyant material selected from the group consisting of foam, pressurized gas, a fuel gas derived from a phase change of a fuel source and a product gas derived from a chemical reaction between two or more reactants.

6. The segmented robotic crawler of claim 1, wherein the buoyancy of the buoyancy control element is controllable to cause the frame units to ascend within the body of water, wherein the buoyancy control elements comprise positive buoyancy control elements.

7. The segmented robotic crawler of claim 1, wherein the buoyancy of the buoyancy control element is controllable to cause the frame units to be suspended at a neutral depth below the surface of the body water.

8. The segmented robotic crawler of claim 1, wherein the buoyancy of the buoyancy control element is controllable to cause the frame units to descend within the body of water, the buoyancy control elements comprising negative buoyancy control elements.

9. The segmented robotic crawler of claim 1, wherein the buoyancy of the buoyancy control element is controllable to adjust an attitude of the frame units suspended in the body water.

10. The segmented robotic crawler of claim 1, wherein an upper portion of each continuous track is lifted above the surface of the water and a lower portion of each continuous track is configured to propel the crawler through the water as the plurality of tread elements move through the water.

11. The segmented robotic crawler of claim 1, wherein a portion of each continuous track is covered and an uncovered portion of each continuous track is configured to propel the crawler through the water as the plurality of tread elements move through and push against the water.

12. The segmented robotic crawler of claim 1, further comprising an asymmetric propulsion-enhancing tread that provides an asymmetric thrust between the opposing surfaces of the tracks to increase the mobility of the robotic crawler through the water.

13. The segmented robotic crawler of claim 1, further comprising means for manipulating the tread elements about the track.

14. The segmented robotic crawler of claim 13, wherein the means for manipulating comprises a mechanical manipulator selected from the group consisting of a guide mechanism that mechanically directs the tread elements depending upon position, a spring and latch mechanism that forces the tread elements closed and latched along a first direction of travel, and that releases the tread elements along a second, opposite direction of travel.

15. The segmented robotic crawler of claim 13, wherein the means for manipulating comprises an electrical manipulator that manipulates the tread elements in response to an electrical signal.

16. The segmented robotic crawler of claim 13, wherein the means for manipulating comprises a fluid manipulator, wherein the tread elements are manipulated in response to a fluid pressure.

17. The segmented robotic crawler of claim 1, wherein the at least one actuated linkage arm is adapted to provide relative rotation between the frame units about a roll axis.

18. The segmented robotic crawler of claim 1, wherein the actuated linkage arm further comprises a steering mechanism, wherein the frame units may be selectively oriented and positioned relative to one another to control steering of the robotic crawler within the water.

19. The segmented robotic crawler of claim 1, further comprising at least one controllable planar surface extending from the frame units to provide additional steering control of the crawler through the water.

20. The segmented robotic crawler of claim 1, wherein the control module further comprises electronic hardware and downloadable software.

21. The segmented robotic crawler of claim 1, further comprising at least one auxiliary propulsion module deployable from a frame unit and configured to propel the crawler through the water.

22. A self-powered amphibious robotic crawler comprising:

at least two frame units, each frame unit further comprising:

a housing containing a drive mechanism;

a continuous track supported therein having at least one surface with tread elements exposed for engagement with a body of water; and a controllable drive unit coupled between the continuous track and the drive mechanism; and at least one actuated linkage arm coupled between the frame units to provide controllable bending about at least two axes and including a steering mechanism;

at least one power supply providing power to the actuated linkage arm and the drive mechanisms of each frame unit;

at least one buoyancy control element disposed on the frame units; and at least one control module operable with the frame units, the control module being configured to direct the robot through the body of water with controllable bending of the at least one linkage arm and controllable movement of the continuous tracks, wherein the plurality of tread elements further comprise a plurality of extendable and one of retractable and foldable type tread elements, and wherein the tread elements one of retract and fold during travel in a first directional motion for disengagement from the water and extend during travel in a second directional motion for engagement with the water.

23. The robotic crawler of claim 22, wherein the buoyancy of the buoyancy control element is controllable by the control module.

24. The robotic crawler of claim 22, further comprising the at least one actuated linkage arm providing controllable relative rotation between the at least two frame units about a roll axis.

25. A method of operating a segmented robotic crawler through a body of water comprising:

providing two frame units coupled by an actuated linkage arm to form a segmented robotic crawler, each frame unit having a continuous track with tread elements coupled to a drive source to provide rotation of the continuous track there around, wherein the plurality of tread elements further comprise a plurality of extendable and one of retractable and foldable type tread elements;

suspending each frame unit in the water with at least one buoyancy control element;

selectively engaging at least one surface of each continuous track with the water during rotation of the track to propel the frame unit through the water, said selectively engaging comprising one of retracting and folding of the plurality of tread elements during travel in a first directional motion for disengagement from the water and facilitating extending of the tread elements during travel in a second directional motion for engagement with the water;

activating the actuated linkage arm to control an angular alignment between the two frame units, wherein controlling the angular alignment results in at least partially steering the crawler; and coordinating rotation of each continuous track and actuation of the actuated linkage arm to direct the crawler along predetermined course through the body of water.

26. The method of claim 25, further comprising filling the buoyancy control element with a positive buoyant material to cause the robotic crawler to ascend or remain neutral within the body of water.

27. The method of claim 25, wherein the positive buoyant material is selected from the group consisting of foam, pressurized gas, a fuel gas derived from a phase change of a fuel source and a product gas derived from a chemical reaction between two or more reactants.

28. The method of claim 25, further comprising filling the buoyancy control element with a negative buoyant material to cause the robotic crawler to descend within the body of water.

29. The method of claim 25, further comprising adjusting the buoyancy of each buoyancy control element to control the depth of the crawler in the body of water.

30. The method of claim 25, further comprising selectively controlling the amount of buoyant material present within a plurality of compartments formed in the buoyancy control element to adjust the attitude of the robotic crawler while traveling through the body of water.

31. The method of claim 25, wherein suspending each frame unit in the water with the buoyancy control element further comprises extending an inflatable receptacle from a side of the frame unit.

32. The method of claim 31, wherein extending the inflatable receptacle further comprises filling the inflatable receptacle with a buoyant material selected from the group consisting of a positive buoyant material and a negative buoyant material.

33. The method of claim 31, further comprising inflating the inflatable receptacle when the crawler enters the body of water and deflating the inflatable receptacle when the crawler leaves the body of water.

34. The method of claim 25, wherein selectively engaging one surface of each continuous track with the water further comprises floating the frame unit at the surface of the body of water to lift an upper portion of the track above the surface to engage a lower portion of the track with the water.

35. The method of claim 25, wherein selectively engaging one surface of each continuous track with the water further comprises covering a portion of the track to engage an uncovered portion of the track with the water.

36. The method of claim 25, wherein activating the actuated linkage arm further comprises bending the linkage arm until the two frame units are orientated substantially side-by-side in a tank configuration.

37. The method of claim 25, further comprising activating a roll joint in the actuated linkage arm to provide relative rotation between the two frame units about a roll axis.

38. The method of claim 25, further comprising rotating the angle of at least one pivoting planar surface extending from each of the two frame units to provide additional steering of the crawler through the water.

39. The method of claim 25, further comprising detaching the buoyancy control element from the frame units when the crawler leaves the body of water.

40. A segmented robotic crawler for traversing about or through a body of water comprising:

at least two frame units including a housing containing a drive mechanism;

a drivable, continuous track operable with each frame unit and rotatably supported around the housing, the track further comprising a plurality of tread elements, wherein at least one surface of the continuous track is exposed to enable engagement with the body of water;

a control module for guiding the robotic crawler in the body of water;

at least one drive unit coupled between the continuous track and the drive mechanism;

at least one actuated linkage arm coupled between the frame units to provide controllable bending about at least two axes; and a controllable planar surface extending from the frame units and adapted to operate with the continuous track to enable the crawler to maintain a desired depth in the body of water, wherein the plurality of tread elements further comprise a plurality of extendable and one of retractable and foldable type tread elements, and wherein the tread elements one of retract and fold during travel in a first directional motion for disengagement from the water and extend during travel in a second directional motion for engagement with the water.

* * * * *